US011523719B2

(12) United States Patent
Xiaofeng

(10) Patent No.: US 11,523,719 B2
(45) Date of Patent: Dec. 13, 2022

(54) DEVICE FOR MOUNTING A TOILET SEAT ASSEMBLY TO AND FROM A TOILET BOWL

(71) Applicant: ZHEJIANG HENGYUAN SANITARY WARE CO., LTD, Linhai (CN)

(72) Inventor: Xu Xiaofeng, Linhai (CN)

(73) Assignee: ZHEJIANG HENGYUAN SANITARY WARE CO., LTD, Linhai (CN)

( * ) Notice: Subject to any disclaimer, the term of this patent is extended or adjusted under 35 U.S.C. 154(b) by 0 days.

(21) Appl. No.: 17/520,464

(22) Filed: Nov. 5, 2021

(65) Prior Publication Data

US 2022/0142421 A1 May 12, 2022

(30) Foreign Application Priority Data

Nov. 6, 2020 (EP) ..... 20206159

(51) Int. Cl.
*A47K 13/12* (2006.01)

(52) U.S. Cl.
CPC ..... *A47K 13/12* (2013.01)

(58) Field of Classification Search
CPC ..... A47K 13/12
USPC ..... 4/236
See application file for complete search history.

(56) References Cited

U.S. PATENT DOCUMENTS

| | | | | |
|---|---|---|---|---|
| 9,833,114 | B2 * | 12/2017 | Etaix | E03D 11/00 |
| 2015/0265110 | A1 * | 9/2015 | Chen | A47K 13/12 4/240 |
| 2020/0288927 | A1 * | 9/2020 | Gong | A47K 13/12 |

FOREIGN PATENT DOCUMENTS

| | | | |
|---|---|---|---|
| CN | 201197690 | Y | 2/2009 |
| CN | 201500071 | U | 6/2010 |
| DE | 202019104335 | | 8/2019 |
| EP | 2946709 | | 11/2015 |
| EP | 3305152 | | 4/2018 |

OTHER PUBLICATIONS

European Search Report dated Apr. 8, 2021 as received in application No. 20206159.4.

* cited by examiner

*Primary Examiner* — Christine J Skubinna
(74) *Attorney, Agent, or Firm* — Maschoff Brennan

(57) ABSTRACT

The device comprises the toilet seat assembly with a toilet lid and a toilet seat, a hinge sleeve that forms an axis that connects the toilet lid and the toilet seat, a hinge body package, and a hinge base with a pin, wherein the pin is connectable to the hinge body package, and wherein the pin comprises a pin axis that defines a vertical direction. The hinge body package comprises a claw part with flexible claws that are configured to lock the pin in a locking position and that are configured to release the pin by bending outwards from the locking position when a pulling force is acting on the pin for releasing the toilet seat assembly from the toilet bowl. The hinge body package further comprises a blocking member that is configured to rotate by a defined angle each time the pin is pushed into the hinge body package.

16 Claims, 9 Drawing Sheets

DEVICE FOR MOUNTING A TOILET SEAT ASSEMBLY TO AND FROM A TOILET BOWL

BACKGROUND

The present disclosure relates to a device for mounting a toilet seat assembly to and from a toilet bowl.

Document EP 3 305 152 B1 discloses a mounting and dismounting mechanism for connecting a toilet seat to a toilet bowl. A locking assembly comprises two opposing slide members that can slide towards each other to lock a pin. The mechanism is actuated by a first push of the pin, wherein the pin is locked. With a second push, the pin is released and the toilet seat can be dismounted.

Document EP 2 946 709 B1 describes a device for attaching a rear part of a toilet seat to a toilet bowl. A quick attachment and release mechanism is provided that includes a pin and a locking assembly with a pivotal arm and a pivotal locking part. As the pin is pushed into the locking assembly, the pivotal locking part engages the pin for a fixation. With a second push of the pin, the pivotal locking part releases the pin and the toilet seat can be removed of the toilet bowl.

The object underlying the present invention is to provide for a further device for mounting and dismounting a toilet seat assembly to and from a toilet bowl.

SUMMARY

Aspects of the invention provide for a device for mounting a toilet seat assembly to and from a toilet bowl that comprises the toilet seat assembly, a hinge sleeve, a hinge body package, and a hinge base with a pin. The toilet seat assembly comprises a toilet lid and a toilet seat. The hinge sleeve forms an axis that connects the toilet lid and the toilet seat. The pin is connectable to the hinge body package and the pin comprises a pin axis that defines a vertical direction. The hinge body package is either arranged in the hinge sleeve and the hinge base is connectable to a toilet bowl, or the hinge body package is connectable to a toilet bowl and the hinge base is connected to the hinge sleeve.

It is provided that the hinge body package comprises a claw part with flexible claws that are configured to lock the pin in a locking position and that are configured to release the pin by bending outwards from the locking position when a pulling force is acting on the pin for releasing the toilet seat assembly. It is further provided a blocking member that is configured to rotate by a defined angle each time the pin is pushed into the hinge body package, wherein, depending on the rotational position of a blocking member, the flexible claws are either inhibited from bending outwards in which case the claws are in the locking position or allowed to bend outwards when a pulling force is acting on the pin to release the pin.

With the device of the present invention, a simple attachment system is provided, wherein the user can easily mount the toilet seat assembly against the toilet bowl and remove it again. Instead of using tools, the user simply needs to push the toilet seat assembly against the base in order to lock it. By pushing a second time, the blocking member is rotated in a position in which the claws can bend outwards and the user can then pull the toilet seat assembly off the toilet bowl.

The flexible claws provide a natural attachment mechanism as they clamp on the pin to hold it. The blocking member, depending on its rotational position, either fixes the locking position by inhibiting the flexible claws from bending outwards, or releases the locking position by allowing the flexible claws to bend outwards. Using a rotational blocking member to inhibit or allow the flexible claws to bend outwards provides a simple yet sturdy solution for a secure installation of the toilet seat assembly against the toilet bowl.

According to an aspect of the invention, with each push of the pin into the hinge body package, the blocking member rotates in a subsequent rotational position, wherein the position of the blocking member alternates between a blocking position in which the flexible claws are inhibited to bend outwards and a releasing position in which the flexible claws are allowed to bend outwards when a pulling force is acting on the pin to release the pin. Accordingly, the blocking member is rotated between blocking positions and releasing positions, wherein rotation of the blocking member is actuated by pushing the pin into the hinge body.

In an embodiment, the blocking member comprises a first (upper) area in which a cylindrical body is formed to hold/position a spring and a second (lower) area in which a blocking member inner wall and recesses in the blocking member inner wall are formed. Further, it is provided that the claws of the claw part reach into the blocking member, wherein the inner wall of the blocking member and the recesses of the inner wall surround the claws. In this manner, one end of the blocking member is provided to hold a spring and the other end of the blocking manner is provided to interact with the claw part.

In a further embodiment, in the blocking position the blocking member inner wall is configured to engage the flexible claws, thereby inhibiting the flexible claws to disengage from the pin. On the other hand, in the releasing position, the recesses of the inner wall of the blocking member are next to the flexible claws, thereby allowing the flexible claws to bend outwards into the adjacent recesses. As the flexible claws are allowed to bend outwards into the adjacent recesses, they disengage from the pin when the pin is pulled outside.

In this aspect, it is provided that the blocking member inner walls' inner diameter is matching to the outer diameter of the flexible claws when the flexible claws engage the pin. Thus, in a blocking position the claws are in contact with the blocking member inner wall and cannot bend outwards. When the blocking member is rotated in a releasing position, the recesses of the inner wall align with the claws and the inner wall is not in contact with the flexible claws anymore. Therefore, the flexible claws can bend outward to release the pin. This mechanism of a rotatable blocking member that can be rotated in a blocking and a releasing position provides a simple and stable solution for a mounting and dismounting device.

In an embodiment, the blocking member comprises at one end protrusions that are formed by angled surfaces and vertical walls. Further, the blocking member may comprise blocking member opening gaps that are vertical recesses in the one end of the blocking member. Such protrusions with the angled surfaces and the vertical walls as well as the vertical recesses in the blocking member can be part of a mechanism to rotate the blocking member when the pin is pushed inside the hinge body package.

According to a further of the invention, the claw part comprises multiple angled surfaces on one end of the claw part. The angled surfaces of the claw part are provided in order to engage with angled surfaces of the blocking member to rotate the blocking member when the pin is pushed inside the hinge body package.

In an embodiment, the hinge body package further comprises a lower shell that is providing a lower housing of the hinge body package. The lower shell comprises an inner wall with at least one guide rip that blocks a rotational movement of the claw part and of the blocking member in the blocking position and the releasing position (in both the blocking position and the releasing position the blocking member is in a lower position; in between these positions, the blocking member is lifted to an upper position in which it is rotatable, as discussed below). In such embodiment, the guide rip may comprise an angled upper surface. The guide rip is further configured to engage with the blocking member in order to rotate the blocking member.

It may be provided that the claw part further comprises at least one guide groove on the outside wall that matches the lower shell guide rip. When the claw part is placed inside the lower shell, the lower shell guide rip is configured to reach into the claw part guide groove to inhibit any rotation of the claw part.

It may be further provided that the blocking member opening gaps are matching to the lower shell guide rip. Thus, when the blocking member is placed in the hinge body package, the lower shell guide groove is configured to reach into the blocking member opening gaps preventing a rotational movement.

According to a further aspect, the hinge body package further comprises an upper shell that is connectable to the lower shell. The upper shell provides for an upper housing of the hinge body package. In particular, the upper end of the blocking member is located in the upper shell. Accordingly, in an embodiment, the housing provided by the lower shell and the housing provided the upper shell house the claw part, the blocking member and a spring. The lower shell and upper shell can be fixedly connected, e.g., by snapping elements.

In a further aspect of the invention, the hinge body package comprises a spring that is arranged between the blocking member and the upper shell, wherein the spring provides a vertical force directed against the blocking member and against the upper shell. In other words, the spring provides for a force that seeks to move the blocking member away from the upper shell. The spring is responsible for pushing the blocking member, after it has been pushed upward into a rotation position, a little bit back downwards into the blocking position or releasing position. The blocking member is pushed upwards by insertion of the pin into the hinge body package, wherein the pin engages the claw part and the claw part pushes the blocking member upwards.

As the blocking member and the claw part are configured to be able to move vertically, the spring ensures a downward orientation as it always pushes the blocking member away from the upper shell in a downward direction against the claw part.

In an aspect of the invention the claw part and the blocking member are configured to move in a vertical direction each time the pin is pushed into the hinge body package.

In an embodiment, the pin comprises a fixing groove, wherein the fixing groove is configured to be engaged by the flexible claws of the claw part in the locking position. Accordingly, in this embodiment, the flexible claws engage with the pin in that the flexible claws reach into a pin groove, wherein the pin groove is formed by a groove ring at the outside surface of the pin in a plane perpendicular to the pin axis. However, this is to be understood as an example only. Alternatively, other structures are formed at the outside surface of the pin that allow engagement of the flexible claws with the pin in the locking position in which the pin is fixed to the claw part.

It is pointed out that, when the claw part is connected to the pin in that the flexible claws engage the fixing groove, the claw part is movable in an axial direction by the inserted pin.

In a further aspect of the invention, the claw part and the blocking member are configured to move in a vertical direction each time the pin is pushed into the hinge body package in that the flexible claws of the claw part are engaged in the fixing groove, thereby providing a connection between the pin and the claw part that provides direct vertical movement of the claw part by the pin. By means of the claw part, further, the blocking member is moved axially.

According to further aspect of the invention, the blocking member is configured, when it is moved in a vertical direction by the pin, to be rotatable/in a rotatable position. As both parts, the claw part and the blocking member, are in contact with each other and are movable in a vertical direction, the blocking member is pushed upwards by the claw part when the claw part is moved upwards by the inserted pin. Thereby, the blocking member is moved to an upper position which is the rotatable position in which the pin is rotatable.

In particular, it may be provided that, in the rotatable position, the blocking member is disengaged of the lower shell guide rip, this allowing the blocking member to rotate around the pin axis. In other words, as the blocking member is moved upwards, it also moves away from the guide rip of the lower shell. Thus, the guide rip is not engaging the blocking member and does not prevent a rotational movement of the blocking member. Hence, the blocking member can rotate around the pin axis.

In a further embodiment, the blocking member—in the rotatable position—is configured to be rotated to a first amount by the interacting angled surfaces of the claw part and the blocking member. As the claw part is pushed upwards against the blocking member, the angled surfaces on the claw parts' upper end are pushed against the blocking member angled surfaces. This results in a rotational force between the two parts. As the claw part cannot rotate because of the engaging lower shell guide rip, the blocking member that is in the rotatable position is rotated.

Further, the blocking member is configured to be moved in a downward direction by the vertical force of the spring when the pin is no longer pushed into the hinge body package, wherein the blocking member angled surfaces are engaged by the angled upper surface of the guide rip resulting in a rotation to a second amount of the blocking member.

Accordingly, when the pin is not pushed into the hinge body package anymore, the blocking member is moved downwards by the spring. As the blocking member moves downwards, its angled surfaces get into contact with the guide rip and the angled upper surface of the guide rip of the lower shell. This results in an additional rotational movement to a second amount of the blocking member as it slides along the angled upper surface of the guide rip until one of the vertical walls of the blocking member get into contact with the guide rip and a further rotation is prevented.

The rotation to a first amount is achieved by pushing the pin into the hinge body package. A rotation to a second amount is further performed as the pin is pushed back again by the spring. The rotation to a first amount and the rotation to a second amount sum up to a rotation into the subsequent rotational position of the blocking member.

Since the rotation to a first and a second amount result in a rotation into the subsequent rotational position of the blocking member, it alternates each time the pin is pushed and let off again between a blocking position and a releasing position.

BRIEF DESCRIPTION OF THE DRAWINGS

The invention will be explained in more detail based on exemplary embodiments with reference to the accompanying drawings in which.

DETAILED DESCRIPTION

Figure 1:
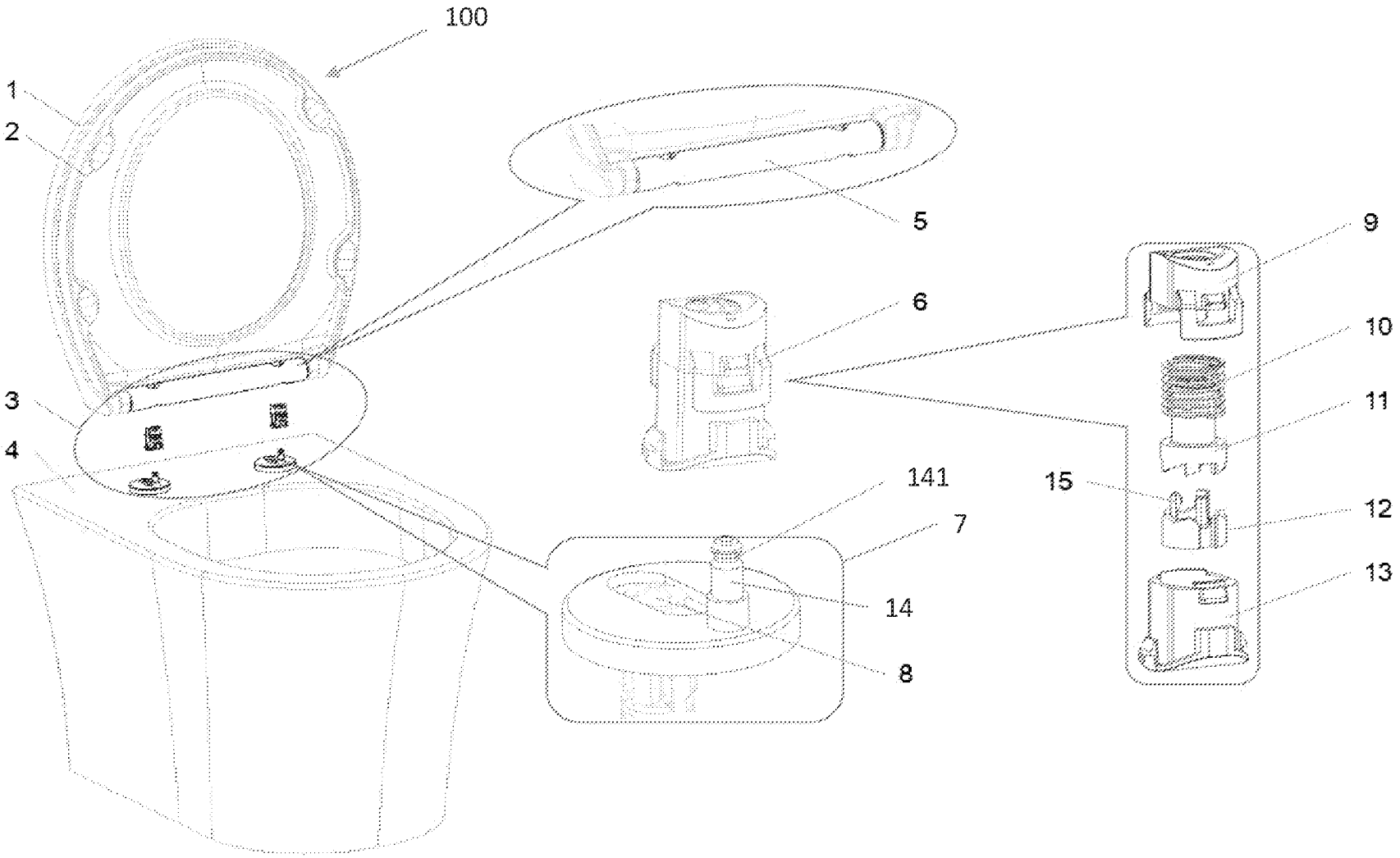
FIG. 1 shows a perspective partially exploded view of an embodiment of a mounting assembly of a toilet comprising a toilet bowl, a toilet seat assembly, a hinge sleeve, a hinge body package and a hinge base.

FIG. 1 shows an embodiment in which a device for mounting a toilet seat assembly 100 comprises a toilet bowl 4, the toilet seat assembly 100, a hinge sleeve 5, a hinge body package 6 and a hinge base 7.

The hinge sleeve 5, the hinge body package 6 and the hinge base 7 form a hinge 3 of the toilet seat assembly 100. The toilet seat assembly 100 comprises a toilet lid 1 and a toilet seat 2. The invention allows a user to easily mount and dismount the toilet seat assembly 100 to and from the toilet bowl 4. Without using tools, the user can push the toilet seat assembly 100 against the hinge base 7 for a safe attachment. With a second push, the toilet seat assembly 100 is releasable again and the user can pull the toilet seat assembly 100 off the toilet bowl 4.

The hinge base 7 is connected to the toilet bowl 4. The way in which the hinge base 7 is connected to the toilet bowl 4 will be discussed with respect to FIG. 5. Basically, a screw 8 serves to deform an element which is then held by friction in or under a hole in the toilet bowl. The hinge base 7 is preassembled to the toilet bowl 4.

The hinge base 7 comprises a pin 14 that is pointing in an upward direction and that is forming a vertical axis. At an upper end of the pin 14 a fixing groove 141 is formed in the pin 14.

The toilet seat 2 and the toilet lid 1 are pivotally connected by the hinge sleeve 5. The hinge body package 6 is integrated into the hinge sleeve 5, wherein respective holes are formed in the hinge sleeve. As the hinge body package 6 becomes attached to the hinge base 7 when the pin 14 is inserted into the hinge body package 6, the hinge body package 6 is the connector between the toilet bowl 4 and the toilet seat assembly 100. The hinge sleeve 5 may be non-rotatingly connected to a damping mechanism (not shown) that is also located within the hinge sleeve 5.

The hinge body package 6 represents an adaptor for the pin 14. It comprises an upper shell 9, a spring 10, a blocking member 11, a claw part 12 and a lower shell 13. The claw part 12 comprises flexible claws 15 that hold onto the pin 14 when the pin 14 is inserted. The upper shell 9 and the lower shell 13 form a housing in which the claw part 12 and the blocking member 11 are vertically movable against the spring 10 and wherein angled surfaces of the blocking member 11 the angled surfaces of the claw part 12 are in contact.

It is provided that with each push of the pin 14, the blocking member 11 rotates in a subsequent rotational position, wherein it alternates between a blocking position in which the blocking member 11 inhibits the flexible claws 15 to bend outwards and a releasing position in which the flexible claws 15 can bend outwards.

Figure 2:
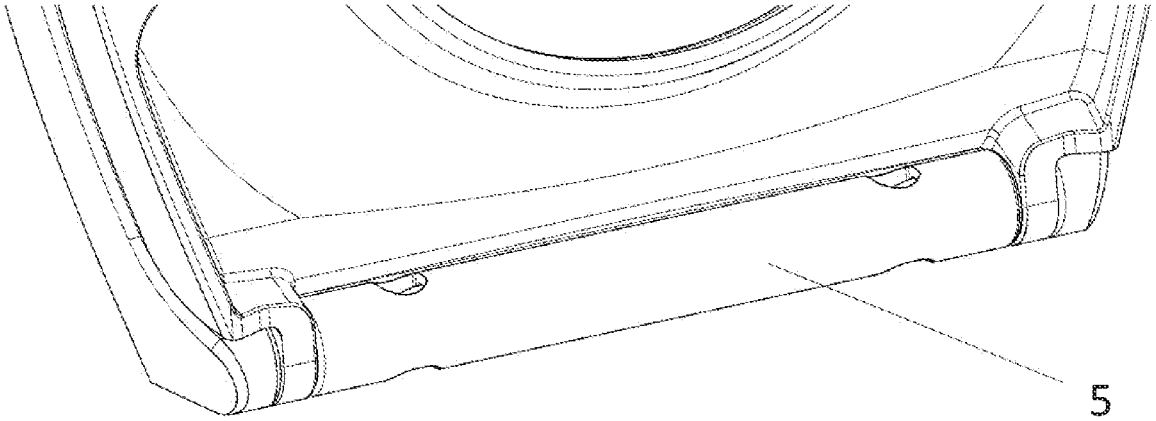
FIG. 2 shows an enlarged view of the hinge sleeve shown in FIG. 1.
Figure 3:
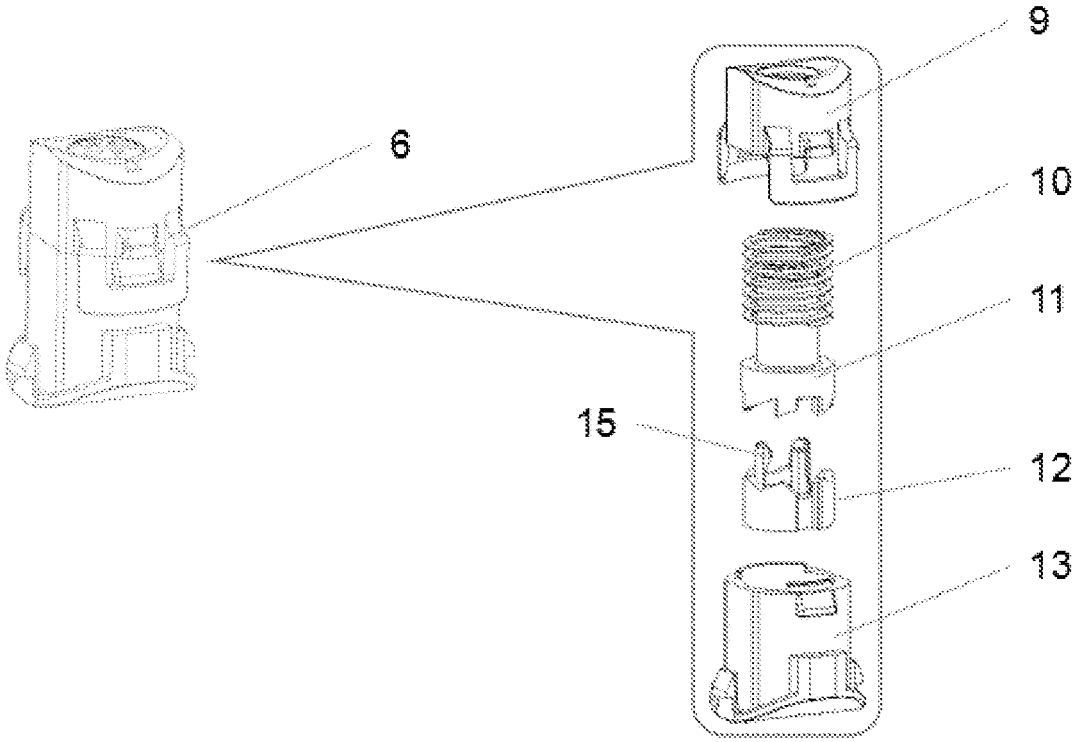
FIG. 3 shows an enlarged view of the hinge body package shown in FIG. 1 having an upper shell, a spring, a blocking member, a claw part and a lower shell.
Figure 4:
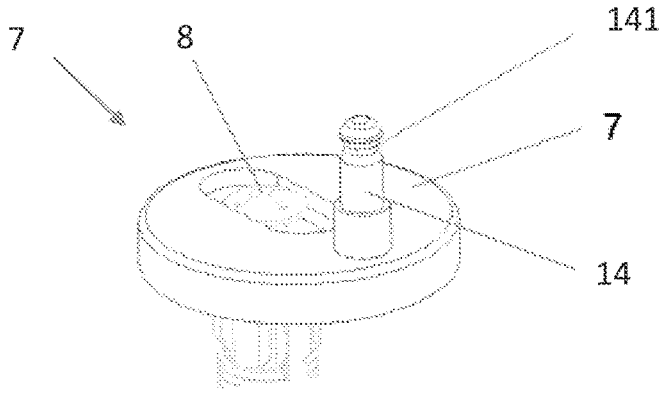
FIG. 4 shows an enlarged view of the hinge base shown in FIG. 1 with a pin having a fixing groove.

FIG. 2, FIG. 3 and FIG. 4 show enlarged views of the hinge sleeve 5, the hinge body package 6 and the hinge base 7.

Figure 5:
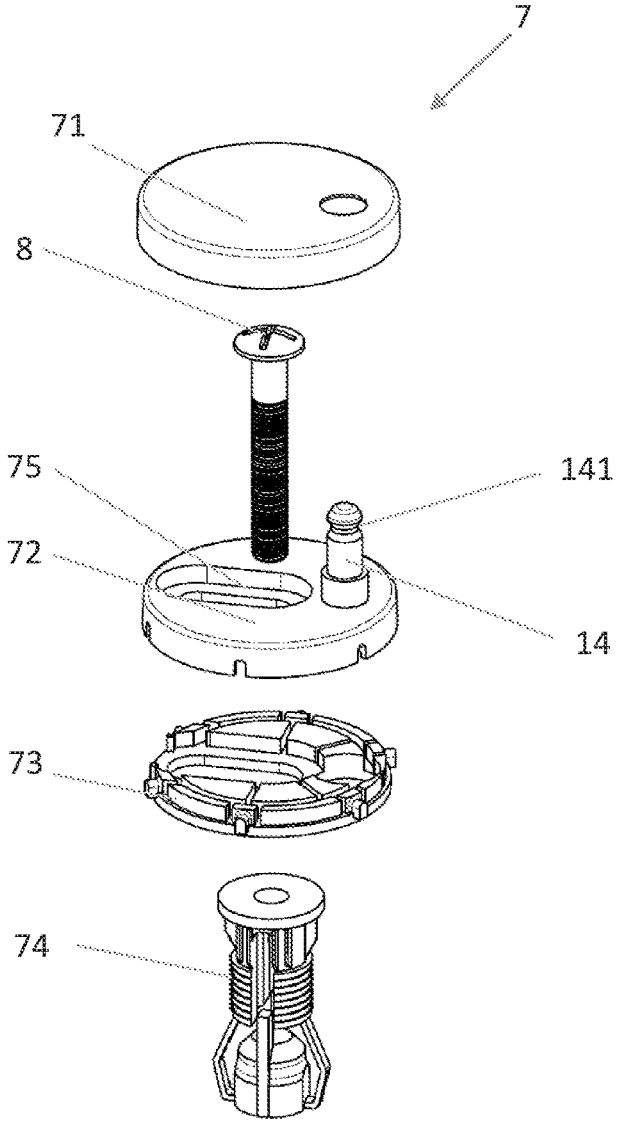
FIG. 5 is an exploded view of the hinge base of FIG. 4, identifying further details of the structure that allows connection of the hinge base to a toilet seat.

FIG. 5 shows an exploded view of the hinge base 7. The hinge base 7 comprises a hinge base plate 72 from that the pin 14 is extending in an upward direction. On the upper end of the pin 14, the fixing groove 141 is formed, wherein the fixing groove 141 is configured to match the flexible claws 15 of the claw part 12. In the hinge base plate 72, a slotted hole 75 is provided. In the slotted hole 75, a screw 8 can be arranged to fixate the hinge base 7 against the toilet bowl. To this end, the screw 8 serves to engage a plastic screw-nut 74 located in a hole of the toilet bowl 4. When the screw 8 is screwed against the screw-nut 74, the lower end of the screw-nut 74 is deformed. The deformation may be under or inside the hole in the toilet bowl, thereby firmly fixing the hinge base 7 to the toilet bowl.

Further, a hinge base cover 71 is placed on top of the hinge base plate 72. The hinge base cover 72 covers the screw 8 and the hinge base plate 72 for visual reasons and has one opening for the pin 14.

Figure 6:
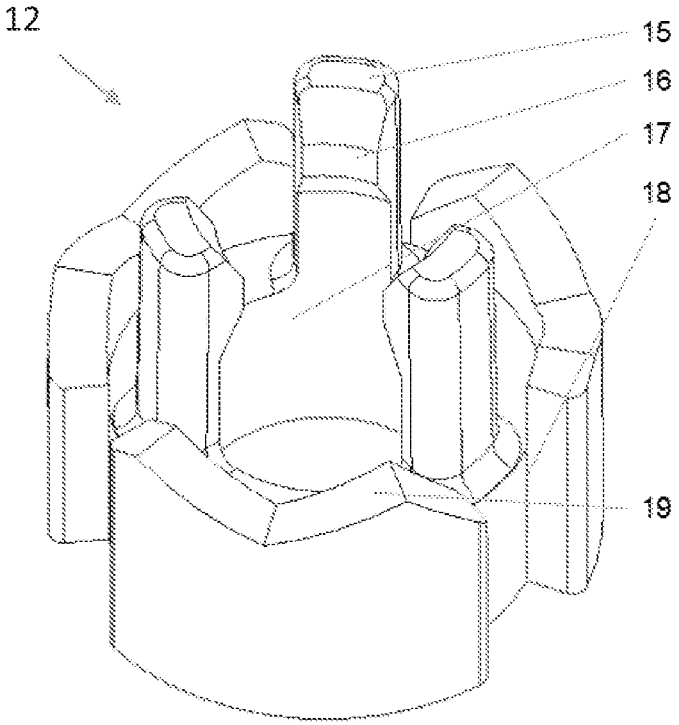
FIG. 6 shows an enlarged perspective view of the claw part of FIGS. 1 and 3, the claw part comprising three claws and three claw part guiding grooves.

FIG. 6 shows the claw part 12 in a detailed view. The claw part 12 is a ring-shaped part with an inner wall 17 which faces to the insight. Three flexible claws 15 are vertically extending over inner wall 17, each of them having a claw projection 16 on the inside that is matching to the fixing groove 141 of the pin 14 shown in FIG. 4.

In the outside wall of the claw part 12, three claw part guide grooves 18 are provided. The upper vertical end of the outside wall is formed by claw part angled surfaces 19 that form teeth, wherein the grooves 18 form gaps between the angled surfaces 19.

Figure 8:
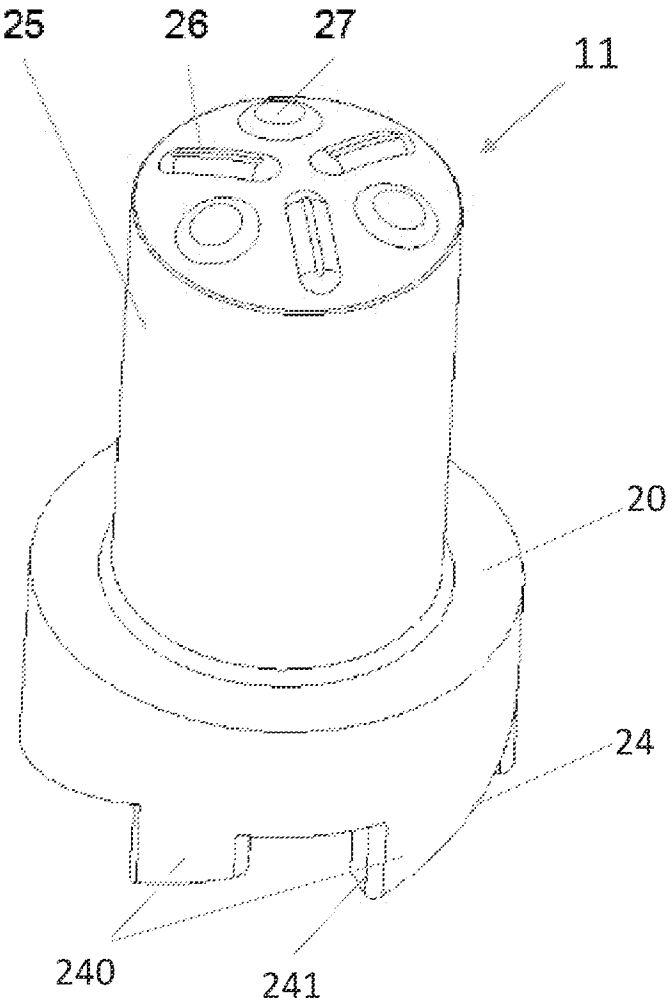
FIG. 8 shows a view of the upper end of the blocking member of FIG. 7 having a cylindrical body.
Figure 7:
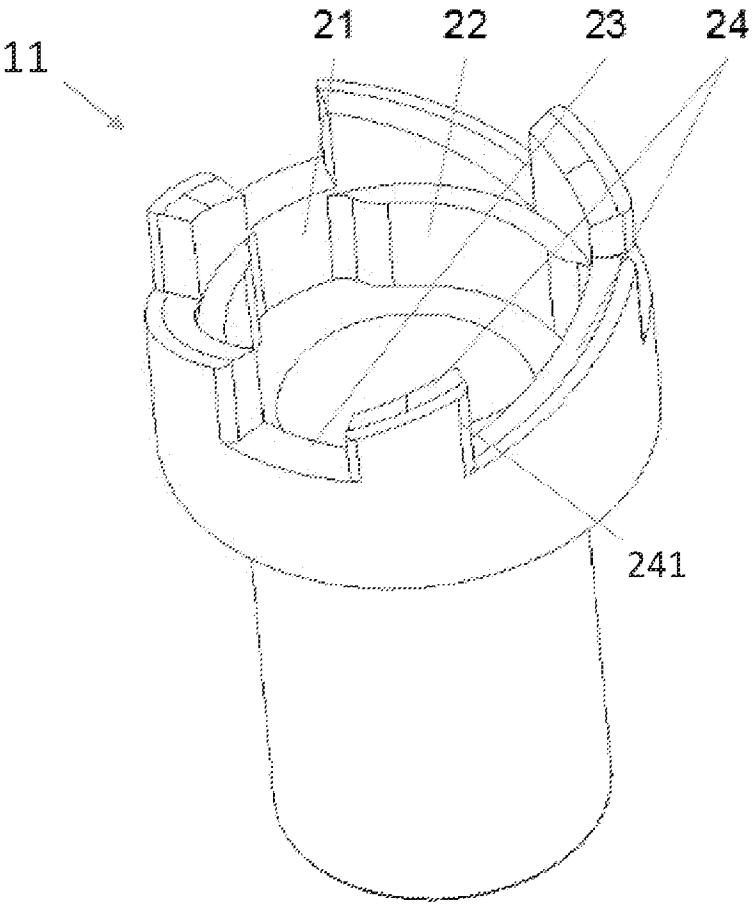
FIG. 7 shows a view of the lower end of the blocking member of FIGS. 1 and 3 with angled surfaces and recesses of the inner wall of the blocking member.

FIG. 7 and FIG. 8 show two views on the blocking member 11. FIG. 7 shows a view on the blocking member 11, wherein the blocking member 11 is turned upside down such that the lower end of the blocking member 11 with its angled surfaces 24 is facing upwards. FIG. 8 shows the blocking member 11 in a normal orientation.

The blocking member 11 is cylindrically formed with a cylindrical body 25 at its first, upper end. A lower, second end forms the angled surface 24. The cylindrical body 25 is configured to extend into the spring 10 (the spring 10 is placed around the cylindrical body 25), whereas the angled surfaces 24 are formed to be in contact with the angled surface 19 of the claw part 12.

The angled surfaces 24 at the lower end of the blocking member 11 are formed by six blocking member wall projections 240 that extend downward from the blocking member 11. Further, three opening gaps 23 are provided between the wall projections 240. Accordingly, some wall projections 240 with angled surfaces 24 are separated by an opening gap 23, and some wall projections 240 with angled surfaces 24 are subsequent without an opening gap 23. The opening gaps 23 are downward facing vertical recesses with a width matching to the width of a lower shell guide 28, shown in FIG. 9.

Inside the blocking member 11, at the blocking members lower end, an inner wall 22 is formed. The inner wall 22 has a diameter that matches the outer diameter of the flexible claws 15 when the flexible claws 15 are engaging the fixing groove 141, shown in FIG. 5 and FIG. 6. Three vertical recesses 21 are formed in the inner wall 22 of the blocking member 12. They have at least the same width as the flexible claws 15 of the claw part 12. They are configured in that way that the flexible claws 15 can bend radially outwards into the recesses thereby allowing the flexible claws 15 to bend outwards.

The blocking member 11 further forms a spring resting wall 20 as a step and horizontal plane. Further, the cylindrical part 25 comprises a blind hole inside that is slightly larger than the pin 14 diameter.

In FIG. 8, the upper end of the blocking member 11 is shown with the cylindrical body 25. On the top end of the cylindrical body 25 three round elevations 26 and three second elongated elevations 27 are formed onto the wall. These elevations 26, 27 serve to indicate the rotational position of the blocking member 11. In other embodiments, another number and/or differently formed elevations may be provided.

Figure 9:
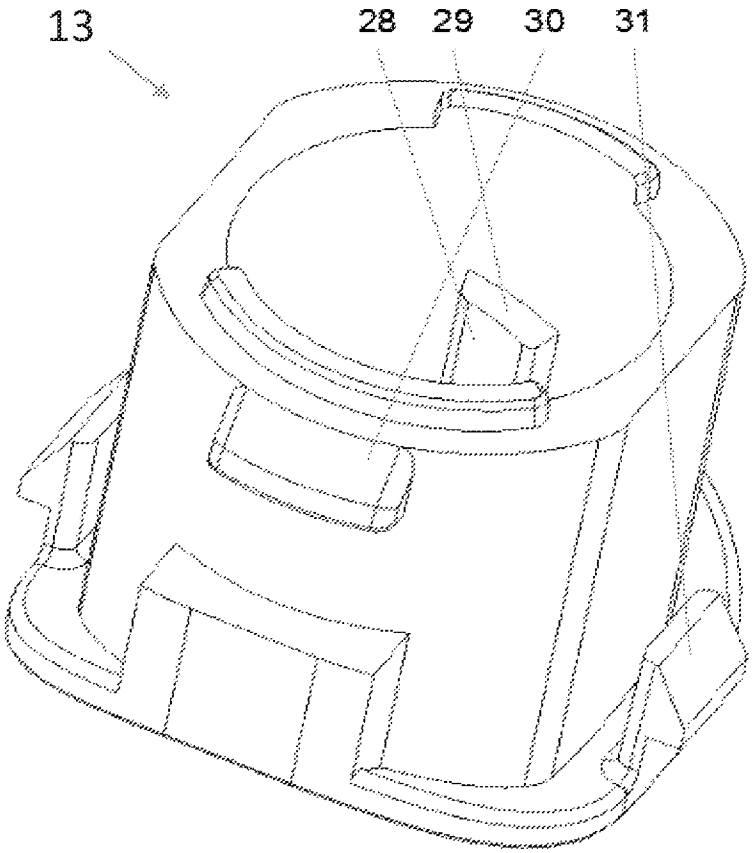
FIG. 9 shows a view of the lower shell of FIGS. 1 and 3 with a guide rip on the inner wall and an upper angled surface of the guide rip.

FIG. 9 shows the lower shell 13. The lower shell 13 can be fixated into the hinge sleeve 5 by two flexible fixing hooks 31 that are arranged on the lower end of the lower shell 13. On the upper end two snapping protrusions 30 are extending in a radial direction. The snapping protrusions 30 can be engaged by a snap 32 of the upper shell 9 shown in FIG. 10 in order to connect the lower 12 and upper shell 12.

On the inside of the lower shell 13 three guide rips 28 are formed onto the inner wall of the lower shell in equidistant circumferential position, wherein only one guide rip 28 is visible in this view. The guide rips 28 have a width matching to the width of the claw part guide grooves 18, shown in FIG. 6 and have an angled upper surface 29.

Figure 10:
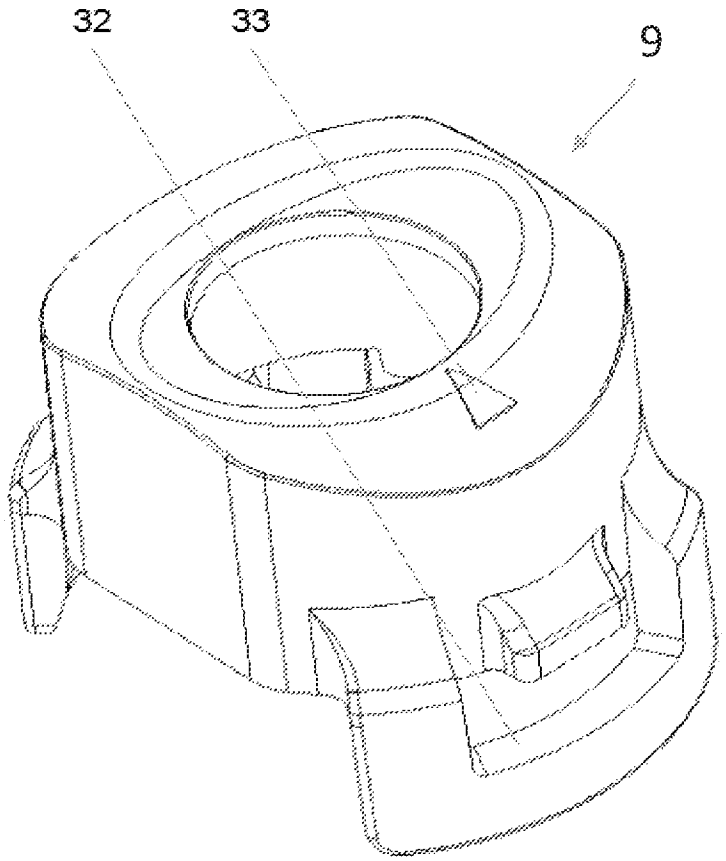
FIG. 10 shows a view of the upper shell of FIGS. 1 and 3.

FIG. 10 shows the enlarged upper shell 11 with the snap 32 and a third elevation 33. The third elevation indicates the position of the blocking member as further shown in FIG. 15.

Figure 11:
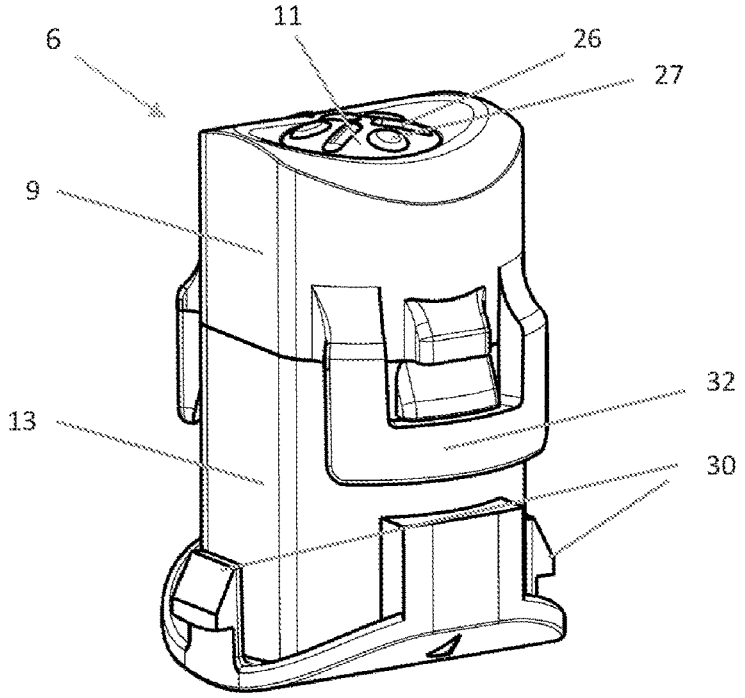
FIG. 11 shows a view on an assembled hinge body package, wherein a lower shell and an upper shell are connected.

In FIG. 11 the complete hinge body package 6 is shown in the assembled condition. Lower shell 13 and upper shell 9 are connected by the snap 32 and the snap protrusion 30. At the upper end of the upper shell 9, the upper end of the blocking member 11 reaches through a hole in the upper shell 13 such that the blocking member first elevation 26 and second elevation 27 are visible.

Figure 12:
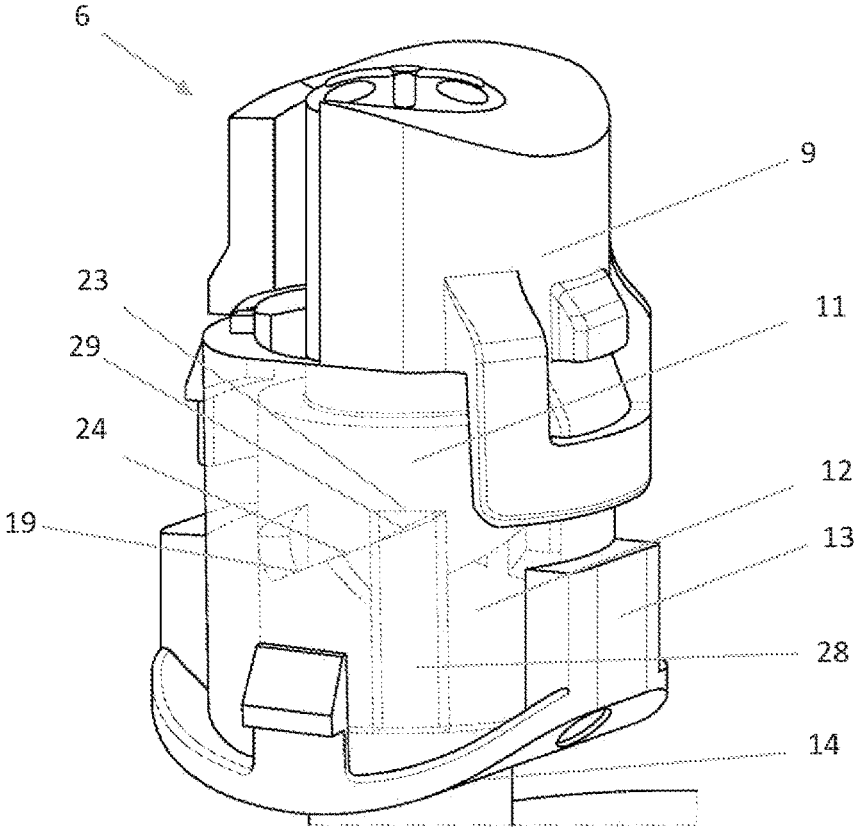
FIG. 12 shows a 3D-model of the hinge body package in which the lower shell is partially broken away to further show elements of the claw part and of the blocking member.

FIG. 12 shows a 3D-model of the hinge body package 6 when a pin is inserted. The lower shell 13 is visualized partially transparently such that the claw part 12, the blocking member 11 and the lower shell guide rip 28 are visible. In this view, the blocking member 11 is pushed downwards by the spring 10 and is in a position in which the blocking member opening gap 23 is sitting on top of the lower shell guide rip 28 that is preventing a rotational movement of the blocking member 11.

When the pin 14 is pushed into the hinge body package 6, the flexible claws 15 engage the fixing groove 141 of the pin 14. By that the claw part 12 being connected to the claws 15 is pushed in an upward direction. As the claw part 12 is pushed upwards, its angled surfaces 19 engage the angled surfaces 24 of the blocking member 11 and push the blocking member 11 upwards against the spring 10. This results in a rotatable position of the blocking member 11 in which the blocking member opening gap 23 is no longer in contact with the lower shell guide rip 28. Thus, a rotational movement of the blocking member 11 is no longer prevented. In this position, the blocking member angled surfaces 24 are pushed by the spring 10 against the angled surfaces 19 of the claw part 12. The engagement of the angled surfaces 24, 19 then results in a rotational movement of the blocking member 11 to a first amount.

When the pin 14 is not pushed into the hinge body package 6 anymore, the pin 14, the claw part 12 and the blocking member 11 move downwards and the spring 10 expands again. As the blocking member 11 moves downwards the blocking member angled surfaces 24 get in contact with the angled upper surface 29 of the guide rip 28. With the two angled surfaces 24, 29 engaging the blocking member rotates to a second amount until one of the vertical walls 241 of the blocking member 11 gets in contact with the lower shell guide rip 28 and halts the blocking member 11.

With this mechanism, the blocking members 11 rotational position is rotated around 60° with each push. However, in other embodiments, different numbers and sizes of guide rips and angled services may be provided such that the blocking members 11 are rotated to a different degree.

As shown in FIG. 6 the blocking member opening gaps 23 are alternately arranged on every second angled surface 24 of the blocking member 11. In such way, the blocking member opening gap 23 sits onto the lower shell guide rip 28 with every second push of the pin 24.

Figure 13:
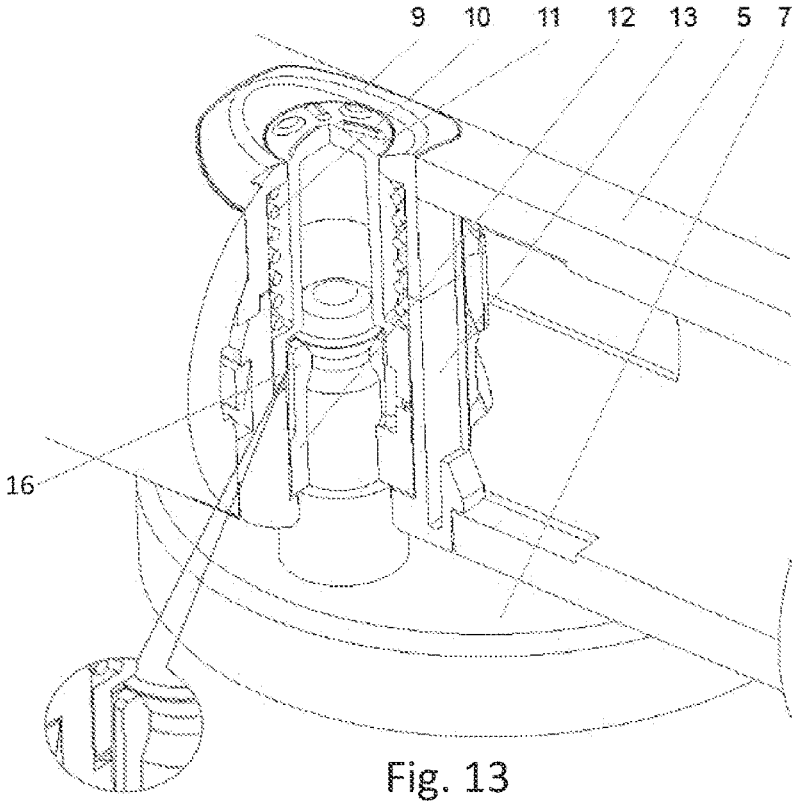
FIG. 13 is a partly sectional view of the mounting assembly in which the pin is inserted into the hinge body package and the blocking member is in a releasing position that allows the claws to open.
Figure 14:
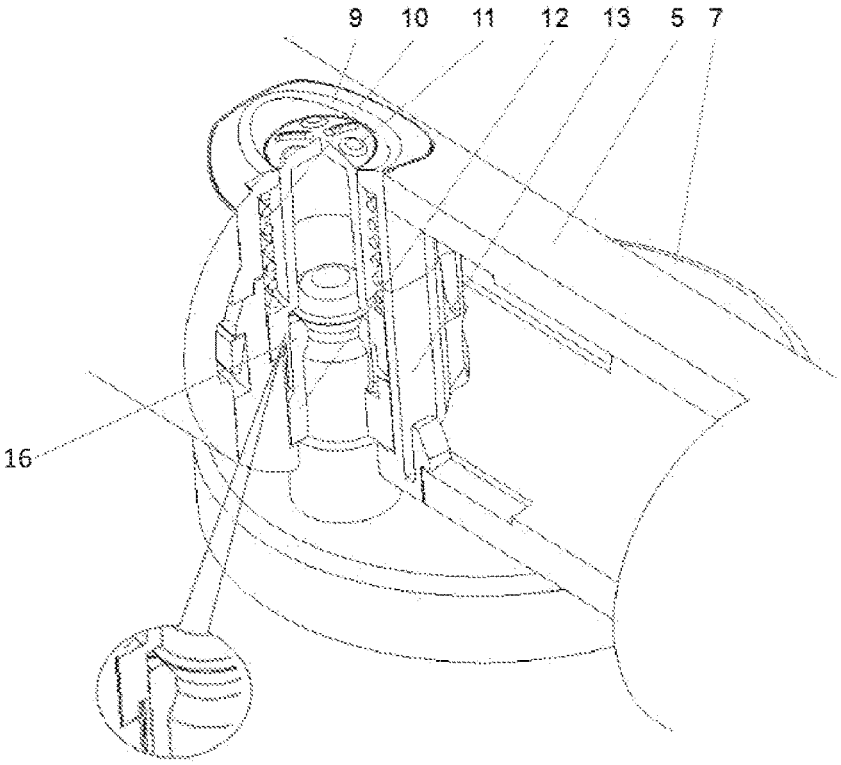
FIG. 14 shows a similar view to FIG. 10 in which the blocking member is in a blocking position inhibiting the claws from bending outwards.

FIG. 13 and FIG. 14 show a section view of the mounting assembly 100, wherein the pin 14 of the hinge base 7 is inserted into the hinge body package 6. FIG. 13 shows the releasing position of the blocking member 11 in which the flexible claws 15 can bend outward to release the pin 14. FIG. 14 shows the blocking position of the blocking member 11 that locks the pin 14 in the hinge body package 6. In particular, in the blocking position of FIG. 14, the radially outside face of the claw projection 16 (see FIG. 6) rests directly against the neighboring wall of the blocking element 11.

When the hinge package is assembled, the blocking member inner wall 22 is surrounding the claws 15 of the claw part 12. As shown in FIG. 5 the recesses 21 of the inner wall of the blocking member are matching to the width of the claws 15. The recesses 21 are placed in such way, that with every second rotational position the claws 15 are in line with the recesses 21. In this position the flexible claws 15 can bend outward when the pin 14 is pulled out of the hinge body package 6 and toilet seat assembly 100 is released.

Figure 15:
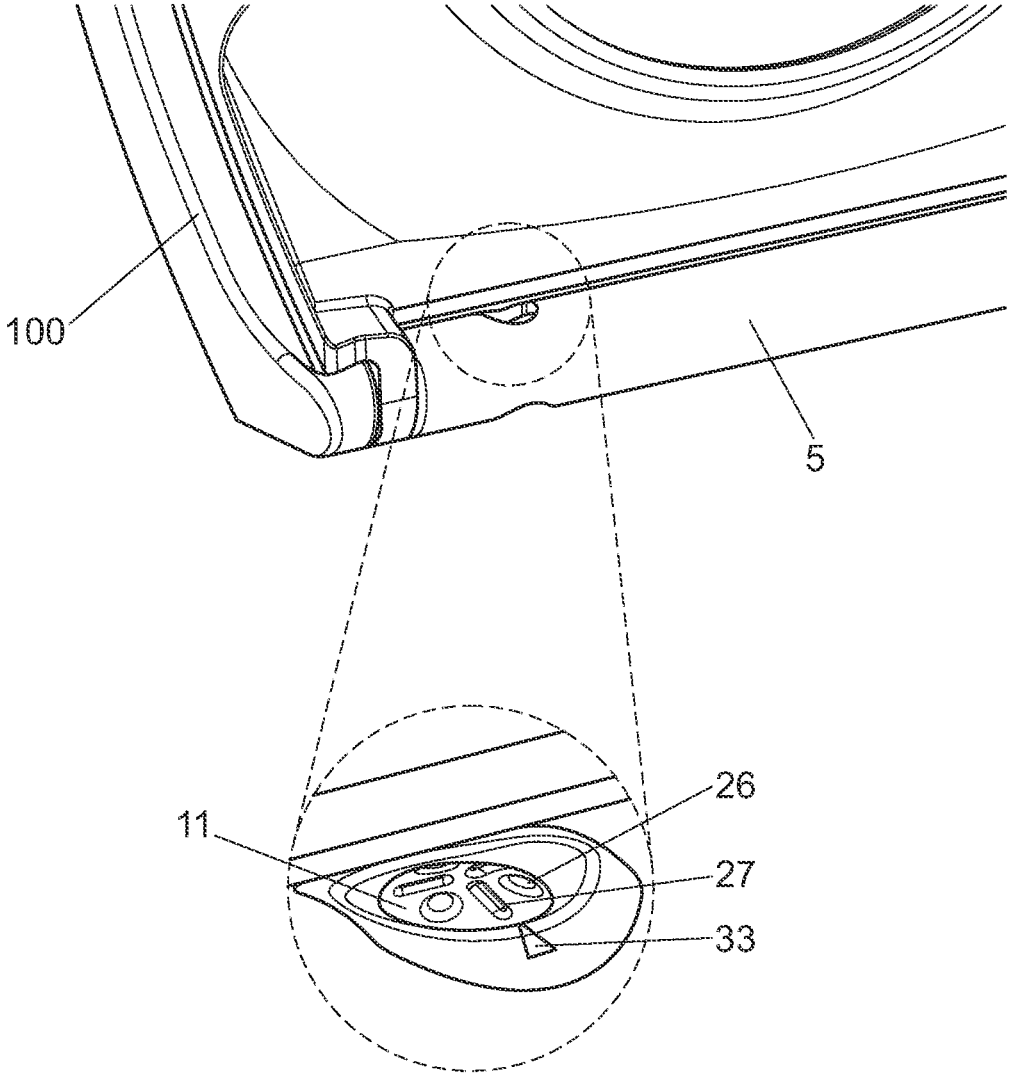
FIG. 15 is an enlarged view onto the upper shell and the blocking member of FIGS. 1 and 3 as integrated into the hinge sleeve of the device.

In FIG. 15 the hinge sleeve 5 is shown in which the hinge body package 6 is arranged. The hinge body package 6 reaches through the hinge sleeve such that the upper end of the blocking member 11 is visible with its round elevations 26 and its elongated elevations 27. The elevations 26, 27, 30 are configured to indicate the rotational position of the blocking member 11. When the elongated elevation 27 and the third elevation 33 align, the blocking member 11 is in a blocking position and when the round elevation 26 and the third elevation 30 align, the blocking member is in a release position. In this way the elevations ensure that a user can see if the toilet seat assembly 100 is locked to the toilet bowl 4 or can be released.

In another embodiment, the hinge body package 6 is connected to the toilet bowl 4 and the hinge base 7 is connected to the hinge sleeve 5, opposite to the description above. However, the structure and function of the connection is the same. The terms "upper" and "lower", however, are then reversed.

It should be understood that the above description is intended for illustrative purposes only and is not intended to limit the scope of the present disclosure in any way. Also, those skilled in the art will appreciate that other aspects of the disclosure can be obtained from a study of the drawings, the disclosure, and the appended claims. All methods described herein can be performed in any suitable order unless otherwise indicated herein or otherwise clearly contradicted by context. Various features of the various embodiments disclosed herein can be combined in different combinations to create new embodiments within the scope of the present disclosure. In particular, the disclosure extends to and includes all combinations and sub-combinations of one or more features described herein. Any ranges given herein include any and all specific values within the range and any and all sub-ranges within the given range.

The invention claimed is:

1. A device for mounting a toilet seat assembly to and from a toilet bowl that comprises:

the toilet seat assembly, wherein the toilet seat assembly comprises a toilet lid and a toilet seat, a hinge sleeve that forms an axis that connects the toilet lid and the toilet seat, a hinge body package, a hinge base with a pin, wherein the pin is connectable to the hinge body package, and wherein the pin comprises a pin axis that defines a vertical direction, wherein either the hinge body package is arranged in the hinge sleeve and the hinge base is connectable to a toilet bowl, or the hinge body package is connectable to a toilet bowl and the hinge base is connected to the hinge sleeve, wherein the hinge body package comprises:

a claw part with flexible claws that are configured to lock the pin in a locking position and that are configured to release the pin by bending outwards from the locking position when a pulling force is acting on the pin for releasing the toilet seat assembly from the toilet bowl, a blocking member that is configured to rotate by a defined angle each time the pin is pushed into the hinge body package, wherein, depending on the rotational position of a blocking member, the flexible claws are either inhibited from bending outwards in which case the flexible claws remain in the locking position or allowed to bend outwards when a pulling force is acting on the pin to release the pin.

2. Device according to claim 1, wherein with each push of the pin into the hinge body package, the blocking member is configured to rotate in a subsequent rotational position, wherein the position of the blocking member alternates between a blocking position in which the flexible claws are inhibited to bend outwards and a releasing position in which the flexible claws are allowed to bend outwards when a pulling force is acting on the pin to release the pin.

3. Device according to claim 1, wherein the blocking member comprises a first area in which a cylindrical body is formed to position a spring, comprises a second area in which a blocking member inner wall and recesses in the blocking member inner wall are formed, wherein the flexible claws of the claw part reach into the blocking member, and wherein the inner wall and the recesses of the inner wall surround the claws.

4. Device according to claim 3, wherein with each push of the pin into the hinge body package, the blocking member is configured to rotate in a subsequent rotational position, wherein the position of the blocking member alternates between a blocking position in which the flexible claws are inhibited to bend outwards and a releasing position in which the flexible claws are allowed to bend outwards when a pulling force is acting on the pin to release the pin, and in the blocking position, the blocking member inner wall is configured to engage the flexible claws, thereby inhibiting the flexible claws to disengage from the pin, wherein in the releasing position the recesses of the inner wall of the blocking member are next to the flexible claws allowing the flexible claws to bend outwards into the adjacent recesses in order to disengage the pin.

5. Device according to claim 1, wherein the blocking member comprises at one end protrusions that are formed by angled surfaces and vertical walls.

6. Device according to claim 1, wherein the claw part comprises multiple angled surfaces at an end of the claw part.

7. Device according to claim 1, wherein with each push of the pin into the hinge body package, the blocking member is configured to rotate in a subsequent rotational position, wherein the position of the blocking member alternates between a blocking position in which the flexible claws are inhibited to bend outwards and a releasing position in which the flexible claws are allowed to bend outwards when a pulling force is acting on the pin to release the pin, and the hinge body package further comprises a lower shell that provides a lower housing of the hinge body package, wherein the lower shell comprises an inner wall with at least one guide rip that blocks a rotational movement of the claw part and of the blocking member in the blocking position and the releasing position.

8. Device according to claim 7, wherein the guide rip comprises an angled upper surface.

9. Device according to claim 7, wherein the hinge body package further comprises an upper shell that is connectable to the lower shell, the upper shell providing an upper housing of the hinge body package, and in that the hinge body package further comprises a spring that is arranged between the blocking member and the upper shell, wherein the spring 10 provides a vertical force directed against the blocking member and against the upper shell.

10. Device according to claim 1, wherein the claw part and the blocking member are configured to move in a vertical direction each time the pin is pushed into the hinge body package.

11. Device according to claim 1, wherein the pin comprises a fixing groove, wherein the fixing groove is configured to be engaged by the flexible claws of the claw part in the locking position.

12. Device according to claim 11, wherein the claw part and the blocking member are configured to move in a vertical direction each time the pin is pushed into the hinge body package, wherein the flexible claws of the claw part are engaged in the fixing groove, thereby providing a connection between the pin and the claw part that provides direct vertical movement of the claw part by the pin.

13. Device according to claim 1, wherein the claw part and the blocking member are configured to move in a vertical direction each time the pin is pushed into the hinge body package, wherein the blocking member is configured, when it is moved in a vertical direction by the pin, to be in a rotatable position.

14. Device according to claim 7, wherein the claw part and the blocking member are configured to move in a vertical direction each time the pin is pushed into the hinge body package, wherein the blocking member is configured, when it is moved in a vertical direction by the pin, to be in a rotatable position, and wherein in the rotatable position the blocking member is disengaged of the lower shell guide rip allowing the blocking member to rotate around the pin axis.

15. Device according to claim 14, wherein the blocking member comprises at one end protrusions that are formed by angled surfaces and vertical walls, and the claw part comprises multiple angled surfaces at an end of the claw part, wherein in the rotatable position the blocking member is configured to be rotated to a first amount by the interacting angled surfaces of the claw part and the blocking member.

16. Device according to claim 15, wherein with each push of the pin into the hinge body package, the blocking member is configured to rotate in a subsequent rotational position, wherein the position of the blocking member alternates between a blocking position in which the flexible claws are inhibited to bend outwards and a releasing position in which the flexible claws are allowed to bend outwards when a pulling force is acting on the pin to release the pin, the hinge body package further comprises a lower shell that provides a lower housing of the hinge body package, wherein the lower shell comprises an inner wall with at least one guide rip that blocks a rotational movement of the claw part and of the blocking member in the blocking position and the releasing position, the guide rip comprises an angled upper surface, the hinge body package further comprises an upper shell that is connectable to the lower shell, the upper shell providing an upper housing of the hinge body package, and in that the hinge body package further comprises a spring that is arranged between the blocking member and the upper shell, wherein the spring provides a vertical force directed against the blocking member and against the upper shell, and the blocking member is configured to be moved in a downward direction by the vertical force of the spring when the pin is no longer pushed inside the hinge body package, wherein the blocking member angled surfaces are engaged by the angled upper surface of the guide rip resulting in a rotation to a second amount of the blocking member, wherein the rotation to a first amount and the rotation to a second amount sum up to a rotation into the subsequent rotational position of the blocking member.

* * * * *